United States Patent [19]

Brown

[11] 4,209,101

[45] Jun. 24, 1980

[54] TAMPER-PROOF CLOSURE AND METHOD OF MAKING SAME

[75] Inventor: Gaylord Brown, Beaverton, Mich.

[73] Assignee: Sweetheart Plastic, Inc., Wilmington, Mass.

[21] Appl. No.: 833,074

[22] Filed: Sep. 14, 1977

[51] Int. Cl.[2] ..... B65D 41/32

[52] U.S. Cl. ..... 215/253; 215/218; 215/341; 215/348

[58] Field of Search ..... 215/214, 216, 218, 253, 215/257, 305, 323, 328, 331, 337, 341, 348

[56] References Cited

U.S. PATENT DOCUMENTS

| | | | |
|---|---|---|---|
| 1,214,675 | 2/1917 | Heath | 215/253 |
| 3,325,035 | 6/1967 | Strickman | 215/348 |
| 3,399,796 | 7/1968 | Steiner | 215/216 |
| 3,480,170 | 11/1969 | Evans | 215/216 |
| 3,482,725 | 12/1969 | Exton | 215/337 |
| 3,606,063 | 9/1971 | Childs | 215/330 |
| 3,612,323 | 10/1971 | Malich | 215/214 |
| 3,648,874 | 3/1972 | Maller | 215/328 |
| 3,866,845 | 2/1975 | Keeler | 215/341 |
| 3,881,623 | 5/1975 | Landen | 215/216 |
| 3,899,097 | 8/1975 | Aichinger | 215/253 |

FOREIGN PATENT DOCUMENTS

| | | | |
|---|---|---|---|
| 2543812 | 5/1976 | Fed. Rep. of Germany | 215/253 |

*Primary Examiner*—Herbert F. Ross
*Attorney, Agent, or Firm*—John J. Swartz

[57] ABSTRACT

A tamper-proof closure for a container including an endwall and an annular, threaded sidewall. The sidewall includes an internal projection for mating with a part of the container to prevent turning of the closure when the closure is mounted on said container. A tear tab is provided on the sidewall radially outwardly of the projection. The sidewall includes tear facilitating portions on circumferentially opposite sides of the tear tab to enhance tearing of the sidewall on opposite sides of the tear tab to permit the tear tab and the projection to be swung outwardly to a removed position in which the closure can be turned. Another aspect of the invention includes a method of making the closure.

11 Claims, 13 Drawing Figures

TAMPER-PROOF CLOSURE AND METHOD OF MAKING SAME

BACKGROUND OF THE INVENTION

This invention relates to a tamper-proof screw type container closure and more particularly to a thermoplastic synthetic plastic tamper-proof screw type container closure having an internal projection which normally precludes rotation of the closure on the container, and an integral tear tab which can be swung radially outwardly and upwardly to move the locking projection to an unlocked position permitting removal of the closure.

Container closures with liners have been provided heretofore to seal the lip of the container and prevent leakage of the container contents. Such liners sometimes comprise a disc of sealing material which is secured to the closure topwall by adhesive. The manufacture of such devices includes an extra step in the manufacturing process.

Another container closure is disclosed in the U.S. Pat. No. 3,866,845 granted to Frederick D. Keeler on Feb. 18, 1975. The Keeler Patent discloses a container closure made from a sandwich of two different materials which are bonded together and then molded to the required cap shape. External threads are formed on the sidewall or skirt of the container closure disclosed in the Keeler et al Patent. In the Keeler et al device, the finished product includes a liner which is bonded to the outer shell of the closure throughout the entire inner surface of the container.

Accordingly, it is an object of the present invention to provide a container closure having an outer shell and an inner foam liner which are concurrently molded to the shape of the closure but without sealing the foam liner to the entire inner surface of the endwall of the closure.

It is another object of the present invention to provide a method of making a container closure wherein superposed sheets of different materials are deformed to form a closure with internal threads bonded along only a portion thereof.

The Keeler et al patent discloses a container closure having an external thread. Container capper machines utilized to cap bottles generally have expansible and contractible jaws which must grip the outside of the container cap as the cap is being applied to the bottle. Some of the prior caps have a generally smooth outer sidewall surface and thus some of the capper machines incorporate rubber jaws which grip the outside of the container cap to minimize slippage of the jaws and the cap during the capping operation. The walls of the caps are generally quite thin, and the clamping pressure of the rubber jaws sometimes deforms the caps and thus causes problems during the capping operation.

Another prior art cap construction has incorporated circumferentially spaced serrations in the sidewall of the cap above the uppermost external thread. Attempts have been made to substitute metal jaws for the rubber clamping jaws. This construction is sometimes unsatisfactory because the gripping area is insufficient. Accordingly, it is another object of the present invention to provide a container closure having an increased capper gripping surface.

Still another object of the present invention to provide a container closure of the type described having a sidewall provided with internal threads and corrugations axially above and below the threads to enhance gripping by the capping jaws.

Container closures have been formed with internal threads heretofore, but such closure threads are formed by merely increasing the thickness of the sidewall at the thread portion of the cap. Such a construction has the disadvantage of utilizing substantially increased material. Accordingly, yet another object of the invention is to provide an internally threaded container closure of the type described having a sidewall which is substantially uniform in radial thickness.

A tamper-proof closure is disclosed in the U.S. Pat. No. 3,980,195 issued to William E. Fillmore on Sept. 14, 1976. This patent discloses a split, tamper-proof ring which is connected to the main closure body by a severable connection. This patent also discloses a severable bridge, which extends between the opposed free ends of the ring. The ring has a plurality of internal projections which lock with projection around the container to prevent turning of the ring. When the ring is broken, the resulting free end of the ring is used as a pull tab, to break the severable connection between the closure body and the tamper-proof ring. Housewives frequently encounter substantial difficulty in severing the bridge which is time consuming and irritating to the consumer. Moreover, when the ring is severed, the ring is subject to being inadvertently deposited into, and contaminating, the container contents.

Accordingly, a further object of the present invention to provide a tamper-proof closure having an internal projection which mates with external projections on the container to prevent turning of the closure and which is movable with a radially outwardly swingable breakaway tab to a removed position, so that the closure can be turned.

Another object of the present invention is to provide a tamper-proof container closure including a locking projection which can be moved to an unlocked position, and which remains integral with the closure after it is moved to the unlocked position.

A still further object of the present invention is to provide a tamper-proof bottle cap of the type described including a sidewall integrally mounting a tear facilitating tab including a radially inwardly projecting locking projection.

It is another object of the present invention to provide a tamper-proof bottle cap of the type described including tear facilitating portions on opposite sides of a tear-away tab to permit the tab to be swung radially outwardly and axially to a removed position in which the locking projection can be removed from the container.

Yet another object of the present invention is to provide a tamper-proof container closure of the type described including a sidewall having a substantially uniform radial thickness and having an internal thread formed therein, and a plurality of circumferentially disposed, longitudinal corrugations, on longitudinally opposite sides of the screw thread.

Still another object of the present invention is to provide a tamper-proof closure for a milk container and the like including a cup shaped shell and a complementary inner foam liner which is not bonded to the central portion of the shell endwall.

One of the prior art constructions relies on sufficient torque being applied to the cap to deform the sealing liner against the sealing lip of the container. Such cap constructions require relatively heavy threads. The U.S. Pat. No. 3,980,195 granted to Fillmore discloses an internal, annular sealing ring which bears against the inner surface of the container neck. Such a construction complicates the manufacturing process and requires additional cap material to effect sealing.

The cap constructed according to the present invention has a deformable endwall and a sidewall which is normally spaced from the sidewall of the container neck adjacent the threads. As the cap is turned onto the container, the upper wall of the cap will bear against the sealing lip and will yieldably bow outwardly as the cap is threaded onto the container. Shortly after the cap starts to bow, the sidewall of the cap will "bottom out" against the shoulder of the bottle to further seal the cap to the container.

Accordingly, it is another object of the present invention to provide a container closure which will permit a wider range of torque applied by the cappers during the sealing process.

It is another object of the present invention to provide a closure having an endwall which will seal to the lip of the container and an annular sidewall having a lower terminal edge portion which will thereafter abut and seal to a shoulder portion of the container.

Another object of the present invention is to provide a closure cap of the type described including an integral tear tab which lies in a plane parallel to the plane of the terminal edge of the sidewall and including tear facilitating notches on circumferentially opposite sides of the tab to permit the sidewall of the closure to tear and permit the tab to be swung radially outwardly and upwardly to a removed position.

These and other objects of the present invention will become more readily apparent as the description thereof proceeds.

SUMMARY OF THE INVENTION

A tamper-proof container closure including an endwall and an integral, annular, internally threaded sidewall having an internal locking projection to be received by a portion of the container to prevent relative rotation of the closure on the container; and a radially outwardly projecting tear tab, integral with the sidewall, radially opposite the projection; the sidewall including tear facilitating portions circumferentially adjacent the tab to enhance tearing of the sidewall, and facilitate swinging movement of the projection radially outwardly and upwardly to an unlocked position.

The present invention may more readily be understood by reference to the accompanying drawings in which.

DESCRIPTION OF THE PREFERRED EMBODIMENT

Figure 1:
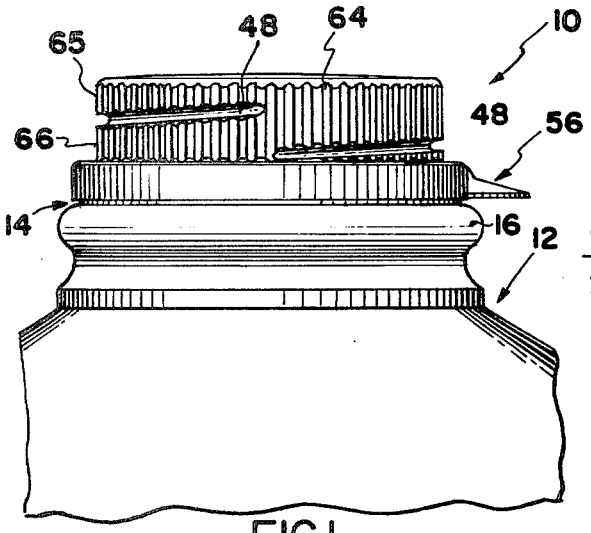
FIG. 1 is a side elevational view of a tamper-proof closure constructed according to the present invention, mounted on the threaded neck of a plastic milk carton.
Figure 2:
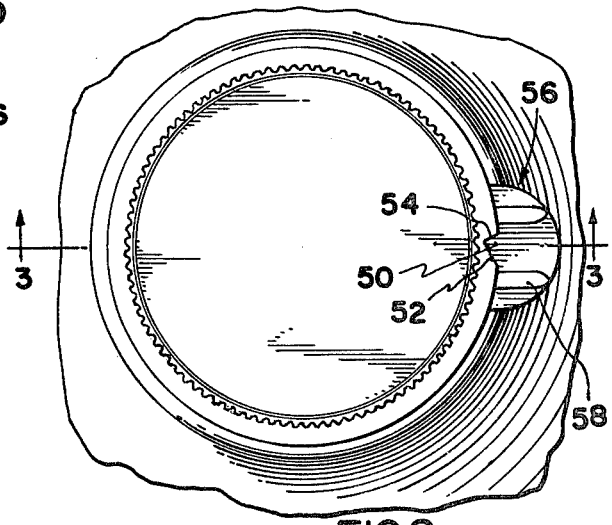
FIG. 2 is an underplan view of the closure illustrated in FIG. 1.

A container closure constructed according to the present invention is generally designated 10 and is particularly adapted for use with a container, generally designated 12. The container 12 comprises a conventional, thermoplastic, hollow container such as a milk container, having a reduced neck generally designated 14. Slightly axially below the neck 14 is an annular handling ring 16. The lower end of the neck 14 includes a slightly enlarged shoulder 18 having a horizontal flange 17 and a vertical, annular wall 19 provided with a plurality of circumferentially disposed, radially outwardly locking projections or rachet teeth, generally designated 20. The teeth 20 include generally radial faces 22 and inclined or relieved faces 24 for a purpose to become apparent hereinafter. Although the teeth 20 could extend entirely around the shoulder 18, conventionally, the teeth extend through only 90° axis on diametrically opposite sides of the neck 14.

The neck 14 includes an upstanding annular sidewall 26 defining an opening 28 which permits fluids, such as milk, to be poured into and out of the container 12. The sidewall 28 is formed with an external thread 30 for generally receiving the tamper-proof closure cap 10 as will be apparent hereinafter.

The upper edge of the sidewall 26 terminates in an annular lip 32 surrounding the opening 28. The annular lip 32 lies in a plane P.

The tamper-proof closure cap, constructed according to the present invention, includes an outer shell, generally designated 34, and an inner liner, generally designated 36. The outer shell 34, which is generally in the shape of an inverted cup, includes a round or circular endwall 38 lying in a predetermined plane and an annular generally vertical sidewall 40. The radial thickness of sidewall 40 is substantially uniform throughout the axial length, thereof. The sidewall 40 includes an annular, generally vertical wall portion 41 and a radially extending flange 42 terminating in a generally vertical, annular skirt 44, which defines a terminal edge 46. The sidewall portion 41 includes an internal thread 48 which is complemental to the container neck external thread 30. The annular skirt 44 includes a radially inwardly projecting locking tang 50 having an inclined face 52 which will slide over the inclined faces 24 on the container as the closure cap is being threaded onto the neck and a generally radial locking wall 54 which mates with the radial wall 22 to prevent reverse threading or removable of the cap 10. The projection 54 prevents removal of the closure 10 and thus prevents tampering of the container contents with contaminant and the like. If the locking projection 50 is removed from the locking teeth on the bottle, the user will know that the container has been tampered with and that the container contents may not be safely consumed.

A tear-away tab 56 is integrally formed with the sidewall skirt 44 and extends generally horizontally, radially outwardly away from the skirt 44 immediately opposite the tang 50. The tang 50 is integral with the radially innermost portion of tab 56. Reinforcement ribs 58 bridge the skirt 44 and the tab 56 on the opposite sides of the tang 50 so that when upward force is applied to the tab 56 in the direction of the arrow 62, it will be transmitted to the sidewall 40.

Figure 7:
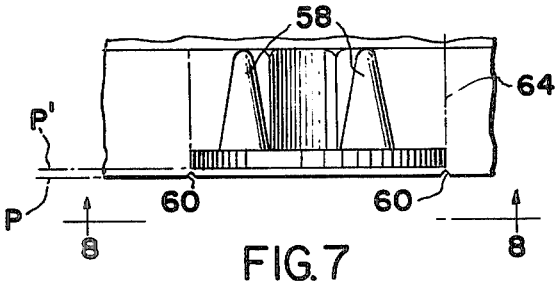
FIG. 7 is an enlarged end view taken along the line 7—7 of FIG. 6.
Figure 8:
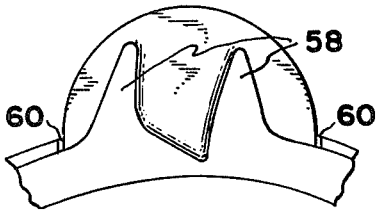
FIG. 8 is an underplan view of the tear tab, taken along the line 8—8 of FIG. 7.
Figure 9:
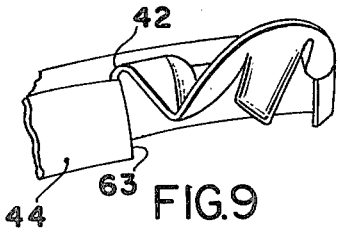
FIG. 9 is a perspective view illustrating the closure with the tear tab in the removed position.

To enhance removal of the locking tang 50 to an unlocked position removed from the teeth 20, the terminal edge 46 of the sidewall skirt 44 is axially notched at 60 on circumferentially opposite sides of the tear tab 56 to enhance axial tearing of the sidewall 44 and permit the tab 56 and the integral projection 50 to be swung radially, outwardly to a position in which the tang 50 is removed from the locking or rachet teeth 24. When force is directed upwardly against the underside of the tab 56, in the direction of the arrow 62, the force is transmitted by the ribs 58 to the sidewall skirt 44 and causes the sidewall skirt 44 to tear along the lines 63 (FIGS. 7 and 9) throughout the vertical skirt 44 and horizontal flange 42. The tab 56, in the removed position, remains integral with the sidewall 40 and thus eliminates the possibility of the tab 56 being inadvertently deposited in the container contents once the closure 10 is removed from the locking position.

The sidewall 40 is formed with a plurality of circumferentially disposed corrugations 64 which includes a corrugated portion 65 above the internal thread 48 as well as a corrugated portion 66 below the thread 48. The corrugations which extend above and below the thread 48 permits metal clamping jaws in capper machines to grip the closure both above and below the thread 48 along the full length of sidewall portion 41.

Figure 10:
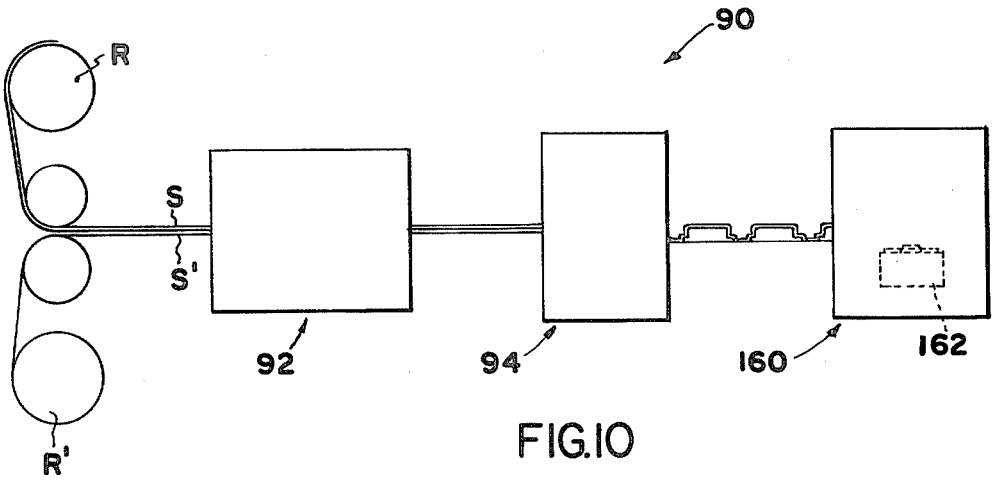
FIG. 10 is a side view schematically illustrating apparatus utilized to accomplish the method according to the present invention.
Figure 11:
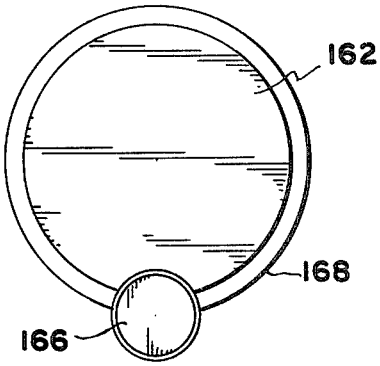
FIG. 11 is an under plan view of the die illustrating in FIG. 5.
Figure 12:
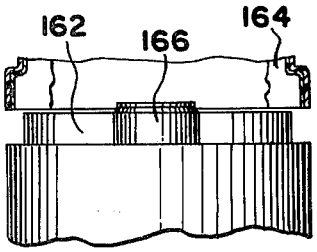
FIG. 12 is a side elevational view of a stamping die utilized to stamp the formed container closure from the plastic sheets.

The thickness t of the sidewall 40 remains uniform throughout the axial length thereof including the corrugations 64 and the threads 48. The thickness T of a typical container endwall or topwall 38 is 0.015 inches whereas the typical thickness t of the sidewall 40 is 0.025 inches. The shell 34 is preferable formed of solid high impact styrene sheet materials S (FIG.10) having an initial thickness of 0.038 inches. The vertical thickness of the formed tab 56 is typically 0.030 inches.

Figure 6:
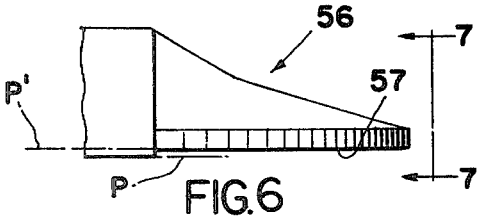
FIG. 6 is an enlarged side elevational view of the tear tab.

It should be noted that the underside 57 of the tear tab 56 lies in a plane p' (FIG. 6) which is parallel to but spaced from the plane p of the terminal edge 46.

Figure 3:
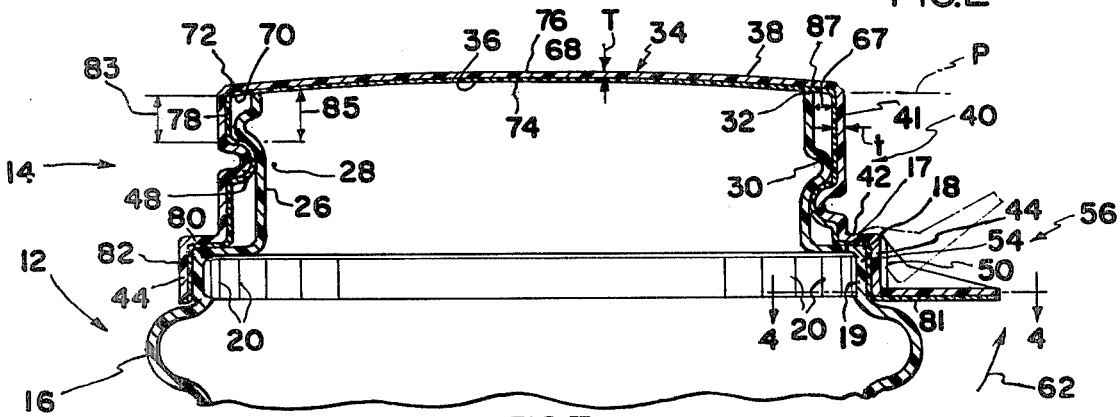
FIG. 3 is an enlarged sectional side view, taken along the line 3—3 of FIG. 2.
Figure 4:
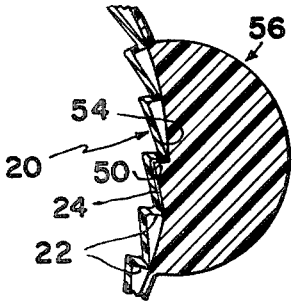
FIG. 4 is a fragmentary, top plan sectional view taken along the line 4—4 of FIG. 3.
Figure 3A:
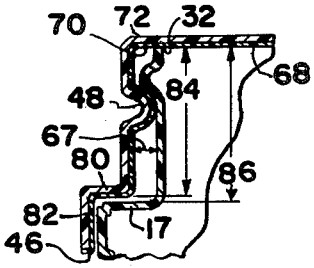
FIG. 3A is a fragmentary view similar to FIG. 3; illustrating the closure in an adjusted position in which the closure endwall bears against the lip of the container but prior to the "bottoming out" of the closure sidewall against the container.

The endwall 34 is flexible to enhance sealing as will become more apparent hereinafter. It should also be noted that the sidewall portion 41 is spaced radially outwardly of the bottle sidewall 26 by a distance designated 67 (FIG. 3 and FIG. 3A). This spacing facilitates sealing of the container closure endwall 34 to the container lip 32 as will become more apparent hereinafter.

The liner 36 comprises a foam gasket of general purpose expanded styrene foam material having an initial thickness in the range of 0.012 inches to 0.030 inches. The foam liner 36 also includes a round endwall 68 which is contiguous to the shell endwall 34 and has a uniform thickness. The liner 36 includes an edge portion 70 which is bonded to the overlying perimetrical edge portion 72 of the container shell 34. The central portion 74 of the foam liner is free of and not bonded to the central portion 76 of the shell 34.

The styrene foam liner 36 includes an integral, annular sidewall 78 which is contiguous with the sidewall 40 and has a shape complemental to the shape of the sidewall 40. The sidewall portion 78 of the foam liner has a uniform thickness throughout the axial length thereof. The foam sidewall 78 includes a horizontal foam flange 80 which is bonded to the overlying shell flange 42 and a terminal skirt portion 82 which is bonded to the shell skirt 44. The liner 36 includes a tear tab portion 81 which is bonded to the underside of the overlying shell tear tab 56.

The foam liner 36 includes an inwardly projecting locking projection portion which intimately covers the internal shell projection 50. The dimensions of the cap is such that the distance 84 between the underside of the liner endwall portion 70 immediately adjacent the sidewall 78 and the underside of the foam liner flange 80 is less than the distance 86 between the plane P and the upper surface of the container shoulder 17 (FIG. 3A). It should also be noted that the distance 83 between the upperside of any portion of the internal thread 48 and the underside of the liner portion 70 is less than the axial distance 85 between the underside of the overlying complemental thread portion of the external thread 30 and the plane P. The difference between the distances 84 and 86 might typically be in the range of 0.020 inches to 0.030 inches. As the tamper-proof closure 10 is threaded onto the bottle neck 14, the underside of the foam endwall 68 will engage the terminal lip 32 before the foam sidewall portion 80 engages the shoulder 17 as illustrated in FIG. 3A. As the closure 10 continues to be threaded onto the container neck, the endwall foam mid-portion 74 and shell mid-portion 76 will be forced upwardly out of the normal planar positions to the bowed position illustrated in FIG. 3 and tightly seal the gasket or liner portion 87 to the bottle lip 32. After the container closure continues to slightly turn and the cap is bowed, the flange 80 will butt against the shoulder 17 and will "bottom out" to prevent further turning of the container closure 10. The mating portions 80 and 17 will further seal the closure.

The container closure 10 need not rely solely on sufficient torque being applied to the threads to effect sealing of the endwall to the lip 32. The yieldable shell endwall constantly urges the foam endwall portion 74 into sealing engagement with the lip 32 to seal the container contents.

The bottoming out of the sidewall portion 80 on the shoulder 17 prevents the threads 48 and 30 from "stripping" as might otherwise be the case if the sidewall portion 80 did not bottom out. This feature thus permits lesser material to be utilized in the sidewall of the container closure and yet insure that the threads will not strip if close torquing tolerances are not followed in the capper machine. The engagement of the sidewall portion 80 and shoulder 17 adds another back up seal to secure the container contents. The topwall 74 and 76 will bow upwardly to approximately 0.020 inches to 0.030 inches above the plane P at the center of the container closure when it is fully installed on the container 12.

METHOD OF FORMING

The apparatus 90 such as that disclosed in U.S. Pat. No. 3,664,791, granted to G. W. Brown on May 23, 1972 and incorporated herein by reference, is provided for forming the container closure 10. The apparatus 90 includes a heating station, generally designated 92, which is more particularly described in the referenced U.S. Pat. No. 3,664,791 for heating thermoplastic sheets S and S' to forming temperature. The sheets S and S' are continuous sheets provided by frame supported rolls R and R' respectively. The sheet S as previously described comprises solid high impact styrene material of approximately 0.038 inches whereas the foam sheet S' comprises general purpose expanded styrene foam having a thickness in the range of 0.012 inches to 0.030 inches. A sheet S' of 0.020 inches thickness is quite satisfactory. The sheets S and S' are carried by laterally spaced part chains such as the chains 29 disclosed in referenced U.S. Pat. No. 3,664,791 from the heating station 92 to a mold station, generally designated 94 and generally described in the aforementioned Brown U.S. Pat. No. 3,664,791. The mold 94 is mounted on a vertically movable platen 96 (FIG. 5) as described in the referenced Brown Patent and includes a female mold assembly, generally designated 98, including a mold box 100 defining an opening 102 which axially slidably receives a pair of partible mold or die portions 104 which include outer splines 106 slidably received on keys 108 fixed to plates 110 that are fixed to the housing 100 by bolts 112. The lower ends of the die members 104 include female cavity portions 114 which, in the position illustrated in FIG. 5, cooperate to define a mold cavity 116 having a shape complemental to the finished shape of the closure cap 10. The inside surface of the die members 114 include ribs 118 for forming the internal threads 48 in the sidewalls 40. The die members 104 include vacuum ports 120 which are in communicating relation with a source of vacuum, generally designated V, via ports 122. When vacuum is applied to the ports 120, the sheets S and S' will be drawn upwardly into a engagement with the walls of the cavity 114. The mold box 100 includes coolant passages 124 whereas the die members 104 include coolant passage 126 for receiving coolant from tubes 128.

To aid the movement of the sheets S and S' into the cavity 116, a male plug assist, generally designated 130, is provided and includes an upper end face 132 having an annular, perimetrically extending endface portion 134 which moves the foam sheet portion 70 of foam sheet S' upwardly against the superposed sheet portion 72 of the styrene sheet S so that the sheet portions 70 and 72 bond together. The central portion 135 of the male plug assist 130 is recessed or relieved to preclude the bonding of the opposing central sheet portions 74 and 76.

The upper ends of the die members 104 are internally relieved at 140 to permit the upperends 142 thereof to move together as they are moved downwardly as will be immediately described.

Figure 5:
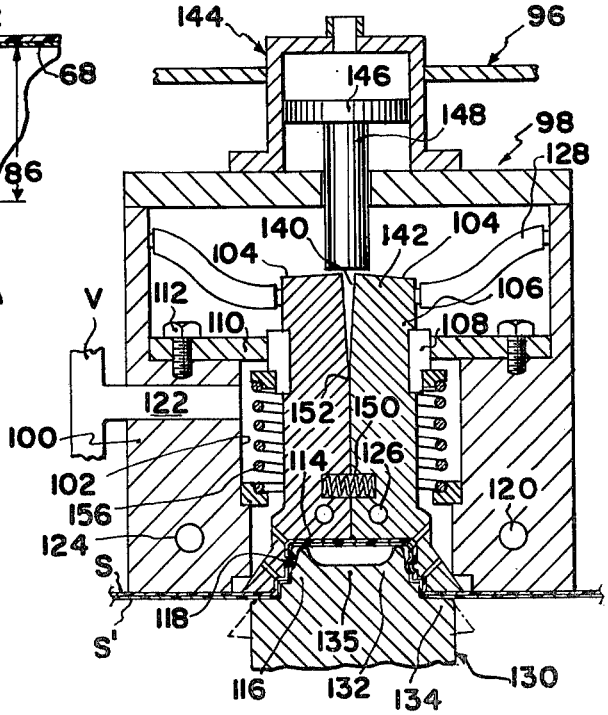
FIG. 5 is a sectional sideview illustrating a mold for forming a cap constructed according to the present invention.

Apparatus is providing for axially moving the die members 104 from the retracted position, illustrated in FIG. 5, to the extended position, illustrated in chain lines of FIG. 5, and includes a hydraulically operated, double acting, solenoid, actuated cylinder 144 having a piston 146, which is axially movable and mounts a piston rod 148 that bears against the upper ends 142 of the die members 104 to move the die members downwardly to the open portion illustrated in chain lines. As the die members 104 move downwardly, the lower ends thereof are forced radially apart by a spring 150. The relieved portions 140 permit the upper die ends 142 to move radially together as the die members move axially and thus permit the lower ends of the die members to move to the spread positions and permit the formed part 10 to be removed from the die cavity. The lower ends of the die members 104 are moved radially outwardly to permit the internal thread forming ribs 118 to be removed from the reduced thread portion 48.

The inclined faces of the relieved die portions 140 join at a fulcrum 152 which is approximately one-half inch below the level of keys 108. The difference in location of the fulcrum relative to the keys 108 also causes the molds to separate as they are moved downwardly and force the lower ends of the molds to spread outwardly as they are moved downwardly.

A spring 156 which surrounds the die members 104, forces the die members 104 to retract to the positions as illustrated in solid lines (FIG. 5) when the piston 148 is retracted. As the molds or die member 104 are moved to the extended positions, the platen 96 is moved upwardly so that the closure 10 formed in the mold will be separated from mold. As soon as the lower ends of the die members 104 clears the endwall 34 of the closure cap, the sheets S and S' are indexed forwardly and the piston 148 is retracted so that the die members 104 can be returned to the positions illustrated in FIG. 5.

The closure 10 formed in the sheets S and S' is then moved downstream to a trimming station 160 which includes a trimming die generally designated 162, which is generally round in shape and conforming in external diameter to the external diameter of the outside dimension of the annular skirt 44. The die 162 is moved upwardly into a complementary formed die receiving chamber 164 to sever the formed container 10 from the sheets S' and S.

The severing die 162 includes a reduced diameter, generally round, punch 166 which projects slightly axially outwardly beyond the face 168 of the die 162. The punch 166 leads the remaining portion of the die 162 and is generally aligned with the tear tab 56. The punch 166 will move the tab 56 out of the plane of the remainder of the sheet to a position in the plane p' which is out of the plane p of the terminal end wall of the closure cap. This has the effect of creating the notches 60 on opposite sides of the tab 56 which facilitates tearing of the sidewall when lifting force is applied to the tab 56 thereafter.

As the previously formed closure is being severed from the sheets S and S', another closure is being concurrently formed at the mold station 94.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claim.

I claim:

1. A thermoformed, tamper-proof bottle cap for a plastic container, such as a plastic milk container and the like, having a neck with an external thread and a plurality of circumferentially disposed radially projecting locking teeth, adjacent said external thread, said cap comprising:

a thermoformed topwall;

an annular axially extending thermoformed sidewall, of a predetermined external diameter, having an upper end integral with said topwall and a lower end;

an enlarged diameter thermoformed skirt, integral with said lower end;

said sidewall having a radially inwardly projecting portion defining an internal thread for threadedly mating with said external thread and alternate projecting and recessed portions on axially opposite sides of said inwardly projecting portion defining said internal thread;

said skirt including a radially outer surface and a radially inner surface having a locking projection, extending radially inwardly therefrom, receivable by said locking teeth for preventing rotation, in one direction, of said cap relative to said container;

said skirt including a radially outwardly projecting tear tab, generally radially aligned with said locking projection;

said skirt including tear facilitating means circumferentially adjacent said tab to enhance axial tearing of said skirt circumferentially adjacent said tab and permit said projection to swing radially outwardly relative to said sidewall to a position removed from said teeth so that said cap and container can be relatively rotated;

and a foam liner, lining the inside of said topwall and sidewall, said foam liner includes an endwall having a central section and a ring portion which encircles said central section, and is bonded to said topwall, said central section being completely free and unattached to said topwall;

the radial thickness of the portion of said sidewall between said topwall and said tear facilitating means, including said projecting and recessed portions and said portion defining said internal thread, being substantially uniform.

2. The tamper-proof bottle cap set forth in claim 1 wherein said foam liner comprises expanded polystyrene foam.

3. The tamper-proof bottle cap set forth in claim 2 wherein said topwall and said sidewall comprises polystyrene material and said liner comprises expanded styrene foam.

4. The tamper-proof bottle cap set forth in claim 1 wherein said tear facilitating means comprises tear facilitating notches in the terminal end of said skirt, on circumferentially opposite sides of said tear tab, to enhance axial tearing of said skirt on circumferentially opposite sides of said tab, the depth of said notches being less than the vertical thickness of said tear tab.

5. The tamper-proof bottle cap set forth in claim 1 wherein said sidewall includes a radially extending flange, said skirt being mounted on said radially extending flange, the radial thickness of said axially extending flange being substantially equal to the axial thickness of said skirt.

6. The tamper-proof cap set forth in claim 5 wherein the radial thickness of said sidewall is substantially equal to the radial thickness of said skirt.

7. The tamper-proof cap set forth in claim 6 wherein said foam liner covers the inner surface of said locking projection and the underside of said tear tab.

8. The tamper-proof cap set forth in claim 7 wherein said foam liner comprises a layer of thermoformed expanded styrene foam.

9. The tamper-proof cap set forth in claim 1 wherein said projecting and recessed portions comprise a plurality of axially extending, alternate crest and valley portions on axially opposite sides of said internal screw thread; the radial thickness of said crest and valley portions being equal to the radial thickness of said portion defining said internal screw thread.

10. The tamper-proof cap set forth in claim 1 wherein said skirt terminates in a terminal edge lying in a predetermined radial plane, said tab lying between said plane and said endwall.

11. In combination:

a container such as a thermoplastic milk carton and the like, including:

a neck having an upper end defining an opening and being provided with an external screw thread;

said neck terminating in an upper terminal lip surrounding said opening and lying in a predetermined plane;

a shoulder, axially inward to said external screw thread projecting radially outwardly of said screw thread;

a tamper-proof thermoformed closure threadedly received on the neck of said container, including:

a circular thermoformed topwall for bearing against the upper terminal lip of said bottle;

an integral, annular, axially extending, thermoformed sidewall having an inwardly projecting portion defining an internal screw thread for mating with said external screw thread; an enlarged diameter skirt projecting radially outwardly and axially away from the lower end of said sidewall; and a foam liner lining the inside of said topwall and said sidewall, said liner includes a central section and a ring portion which encircles said central section, said ring portion being bonded to said topwall, said central section being completely free and unattached to said topwall, the radial thickness of at least that portion of said sidewall extending from said topwall and throughout the axial extent of said screw thread being uniform;

said sidewall including a lower end portion abutting said shoulder when said closure is fully threadedly received by said neck;

said topwall including an outwardly bowable central portion;

the axial distance between the underside of the lower edge of said sidewall and the underside of said topwall immediately adjacent said sidewall being less than the axial distance between said shoulder and said upper terminal lip of said bottle so that said topwall will bear against said upper terminal, lip and outwardly bow said central portion of said topwall when said lower end portion abuts said shoulder.

* * * * *